US005878316A

United States Patent [19]

Giardina

[11] Patent Number: 5,878,316

[45] Date of Patent: Mar. 2, 1999

[54] CLEANING MECHANISM FOR A REPRODUCTION APPARATUS

[75] Inventor: Jamie S. Giardina, Webster, N.Y.

[73] Assignee: Eastman Kodak Company, Rochester, N.Y.

[21] Appl. No.: 755,669

[22] Filed: Nov. 25, 1996

[51] Int. Cl.[6] ..... G03G 21/00

[52] U.S. Cl. ..... 399/347; 399/353

[58] Field of Search ..... 399/347, 353, 399/355

[56] References Cited

U.S. PATENT DOCUMENTS

| | | | |
|---|---|---|---|
| 2,752,271 | 6/1956 | Walkup et al. | 134/1 |
| 3,766,593 | 10/1973 | Becker et al. | 15/308 |
| 3,780,391 | 12/1973 | Leenhouts | 15/1.5 |
| 4,304,026 | 12/1981 | Borostyan | 15/308 |
| 4,475,807 | 10/1984 | Toyoda et al. | 355/15 |
| 4,568,176 | 2/1986 | Murdsawa | 399/347 |
| 4,974,030 | 11/1990 | Tokunaga et al. | 399/347 |
| 5,083,169 | 1/1992 | Usui et al. | 399/353 |
| 5,260,754 | 11/1993 | Yano et al. | 355/296 |
| 5,667,926 | 9/1997 | Maruyama et al. | 399/347 X |
| 5,671,475 | 9/1997 | De Cock et al. | 399/347 |

*Primary Examiner*—Fred L Braun
*Attorney, Agent, or Firm*—Lawrence P. Kessler

[57] ABSTRACT

A cleaning mechanism for removing residual marking particles and other debris from a dielectric member of a reproduction apparatus and polish the dielectric member and remove fine scratches therefrom. The cleaning mechanism includes a substantially cylindrical fiber brush rotatable about its longitudinal axis with the fibers of the brush in contact with the dielectric member. A housing encloses that portion of the fiber brush not in contact with the dielectric member. The housing defines a substantially cylindrical chamber with the inner wall thereof spaced from the outer extremes of the brush fibers. In this manner, residual marking particles and debris are allowed to collect between the fibers of the brush to an extent sufficient to enable the fiber brush, when loaded with such marking particles and debris, to polish the dielectric member and remove fine scratches as the fibers clean the dielectric member.

7 Claims, 1 Drawing Sheet

CLEANING MECHANISM FOR A REPRODUCTION APPARATUS

BACKGROUND OF THE INVENTION

The present invention relates in general to cleaning mechanisms for reproduction apparatus, and more particularly to a housing arrangement for a fiber brush of a cleaning mechanism for a reproduction apparatus which enables the cleaning mechanism to remove residual marking particles and other debris from a dielectric member of a reproduction apparatus and polish the dielectric member and remove fine scratches therefrom.

In typical commercial electrostatographic reproduction apparatus (such as copier/duplicators, printers, or the like), a latent image charge pattern is formed on a uniformly charged charge-retentive or photo-conductive member having dielectric characteristics (hereinafter referred to as the dielectric member). Pigmented marking particles are attracted to the latent image charge pattern to develop such image on the dielectric member. A receiver sheet is then brought into contact with the dielectric member, and an electric field applied to transfer the marking particle developed image to the receiver sheet from the dielectric member. After transfer, the receiver sheet bearing the transferred image is transported away from the dielectric member, and the image is fixed (fused) to the receiver sheet by heat and pressure to form a permanent reproduction thereon. At the same time, the dielectric member is cleaned of any residual (non-transferred) marking particles, and dust or other unwanted particles, so that that portion of the dielectric member can be reused in the formation of additional reproductions.

Cleaning mechanisms for reproduction apparatus typically employ a fur brush rotating inside a housing communicating with a vacuum source. The housing is smaller in diameter than the diameter of the brush. As such the fibers of the brush, and any particles trapped therein, rub against the inside wall of the housing before the vacuum source removes the particles from the fibers. The friction action with the inside housing wall heats up the particles to a temperature where the marking particles at least partially melt and adhere to the housing wall. This debris becomes very brittle and abrasive as it continues to build up on the housing wall. The build up of the particles eventually causes fibers of the cleaning brush to become damaged (such as tearing the fibers out of the brush, for example) to the extent that they are no longer effective in efficiently cleaning the dielectric member. Therefore, debris remains on the dielectric member which eventually will show up as unacceptable artifacts in the reproductions. The hard crusty build up will also begin to chip off the housing wall and become lodged in the brush. These chips will then result in scratches in the surface of the dielectric member, which can become so deep as to also show up as unacceptable artifacts in the reproductions.

In other cleaning mechanisms for reproduction apparatus, the cleaning housing is larger in diameter than the diameter of the cleaning brush. However, such mechanisms utilize mechanical devices on the inside of the housings to contact the brush fibers to aid in dislodging the particle trapped by the fibers. These mechanical devices include flicker bars or protrusions extending radially inwardly from the housing wall. The action of these mechanical devices results in the same problems of fiber damage with the resultant unacceptable artifact generation in the reproductions.

SUMMARY OF THE INVENTION

In view of the foregoing discussion, this invention is directed to a cleaning mechanism for removing residual marking particles and other debris from a dielectric member of a reproduction apparatus and polish the dielectric member and remove fine scratches therefrom. The cleaning mechanism discloses a substantially cylindrical fiber brush rotatable about its longitudinal axis with the fibers of the brush being brought into contact with the dielectric member. A housing encloses that portion of the fiber brush not in contact with the dielectric member. The housing defines a substantially cylindrical chamber with the inner wall thereof spaced from the outer extremes of the brush fibers. In this manner, residual marking particles and debris are allowed to collect between the fibers of the brush to an extent sufficient to enable the fiber brush, when loaded with such marking particles and debris, to polish the dielectric member and remove fine scratches as the fibers clean the dielectric member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
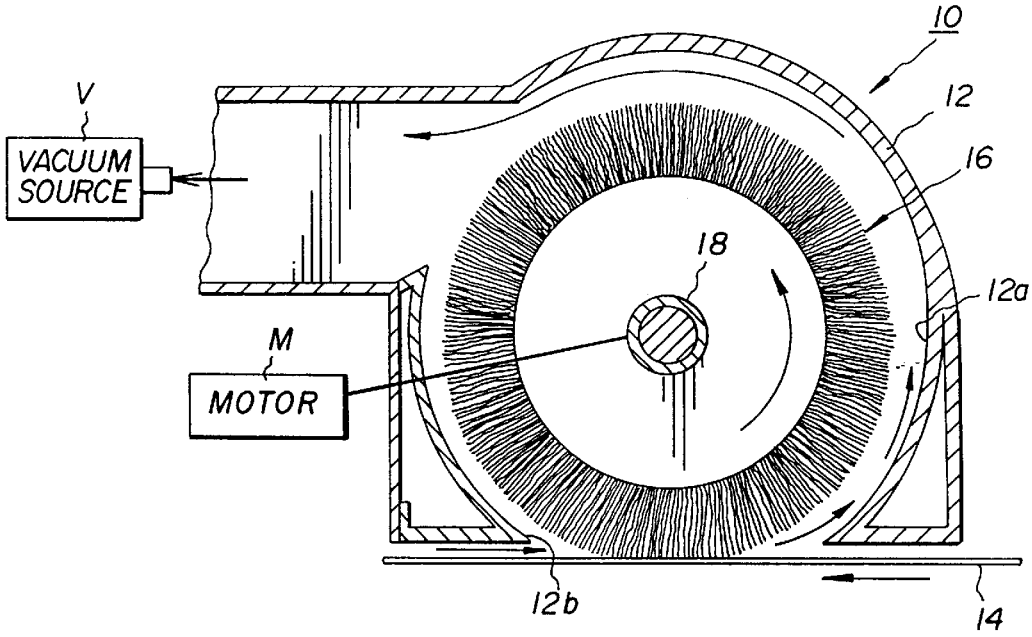
FIG. 1 is a side elevational view, partly in cross-section, of the housing arrangement for a fiber brush of a cleaning mechanism for a reproduction apparatus, according to this invention.

Referring now to the accompanying drawings, FIG. 1 shows a cleaning mechanism, according to this invention and designated generally by the numeral 10, for cleaning a dielectric member, such as web 14, of any typical well known reproduction apparatus. The particular details of the construction of the reproduction apparatus are not significant to this invention and therefore are not shown. The cleaning mechanism 10 is for the general purpose of removing residual marking particles and other debris from the dielectric member of the reproduction apparatus after reproduction copies are formed from marking pigmented particles applied in an image-wise fashion to the dielectric member. Additionally, the cleaning mechanism 10 serves in the manner described below to polish the dielectric member and remove fine scratches from the surface thereof.

The cleaning mechanism 10 includes a fiber brush 16 mounted on a support shaft 18. The support shaft 18 is located substantially concentrically within a housing arrangement 12 to concentrically position the fiber brush within the housing. The housing arrangement 12 is associated with a vacuum source V, and positioned in juxtaposition with the web 14 (dielectric member) of the reproduction apparatus.

The fiber brush 16 is rotatable about the longitudinal axis of the shaft 18, and is typically driven by a suitable motor M in a direction counter-current to the direction of movement of the web 14. For example, as illustrated in FIG. 1, the web 14 moves from right to left while the brush 16 rotates in a counterclockwise direction at a speed in the range of approximately 900 to 1300 RPM. The fibers of the fiber brush 16 are typically formed from acrylic material; however, polypropylene, rayon, and teflon/dacron fibers are also suitable for use in the cleaning mechanism 10 according to this invention.

The housing arrangement 12 encloses a substantial portion of the fiber brush 16 so as to define a substantially cylindrical chamber 12*a* about the brush. The inner wall of the chamber 12*a* is spaced from the outer extremes of the brush fibers by a distance designated by the letter X in FIG. 2. The dimension of the distance X is in the range of up to approximately 0.09 cm., but larger dimensions may be possible as long as the air flow induced by the vacuum source V provides containment of the airborne marking particles and debris. The housing arrangement 12 has an opening 12*b*, located in juxtaposition with the web 14, through which the brush fibers extend into contact with the web. The engagement of the brush fibers with the web is typically in the range of about 0.14 to 0.23 cm.

In operation of the cleaning mechanism 10 of the general construction described, the fiber brush 16 is rotated so as to sweep the surface of the web 14. This will remove loose residual marking particles and debris on the surface of the web. The air flow induced by the vacuum source V captures the removed residual marking particles and debris for removal with the air flow in the well known manner of prior cleaning mechanisms. However, due to the spacing between the inner wall of the housing chamber 12*a* and the outer extreme of the brush fibers, according to this invention a portion of the removed residual marking particles and debris collect between the fibers to load the brush fibers with such marking particles and debris.

Figure 2:
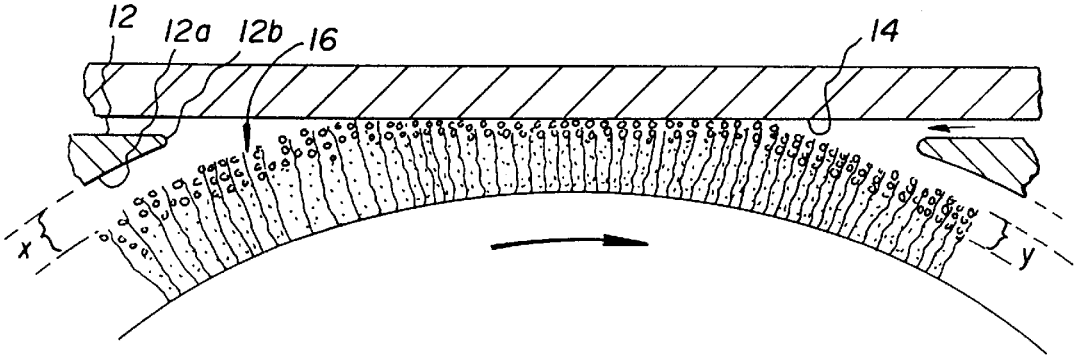
FIG. 2 is a side elevational view of a portion of the housing arrangement for a fiber brush of a cleaning mechanism for a reproduction apparatus as shown in FIG. 1 on an enlarged scale.

The loading of the brush fibers with removed residual marking particles and debris occurs to a depth designated by the letter Y in the FIG. 2. The spacing of the brush fibers from the inner wall of the housing chamber 12*a* enables the brush to remain loaded during the cleaning operation. That is, other than the vacuum induced air flow there is no device in association with the housing 12 which will mechanically act on the fibers of the brush 16 to remove the marking particles and debris which are loaded between the fibers. In a steady state condition (achieved rapidly after initial start up of a clean fiber brush, for example), the loading of the fiber brush will remain substantially constant. Accordingly, as the loaded fibers of the brush 16 contact the web 14, residual marking particles and debris making up the brush loading serve to scrub the surface of the web. This scrubbing action serves to dislodge marking particles and debris (or any other types of scum) adhering to the surface of the web, and to polish the web 14. Moreover, this scrubbing and polishing of the web surface removes fine scratches as the brush fibers clean the web. As such, artifacts in reproduced copies, due to incomplete cleaning of the dielectric member web of a reproduction apparatus, or fine scratches of the web, are substantially eliminated.

The invention has been described in detail with particular reference to preferred embodiment thereof, but it will be understood that variations and modifications can be effected within the spirit and scope of the invention as set forth in the claims.

What is claimed is:

1. A cleaning mechanism for removing residual marking particles and other debris from a dielectric member of a reproduction apparatus and polish said dielectric member and remove fine scratches therefrom, said cleaning mechanism comprising:

a substantially cylindrical fiber brush rotatable about its longitudinal axis with the fibers of said brush in contact with said dielectric member; and a housing for enclosing that portion of said fiber brush not in contact with said dielectric member, said housing defining a substantially cylindrical chamber with an inner wall thereof spaced from the outer extremes of said brush fibers so as to allow residual marking particles and debris to collect between said fibers to an extent sufficient to enable said fiber brush, when loaded with such marking particles and debris, to polish said dielectric member and remove fine scratches as said fibers clean said dielectric member.

2. The cleaning mechanism of claim 1 wherein said fiber brush is substantially cylindrical, and said housing chamber is similarly substantially cylindrical.

3. The cleaning mechanism of claim 2 wherein said cylindrical fiber brush is located so as to be substantially concentric with said cylindrical chamber of said housing.

4. The cleaning mechanism of claim 3 wherein said inner wall of said cylindrical chamber of said housing is spaced from the outer extreme of said brush fibers a distance of a dimension up to approximately 0.09 cm.

5. A cleaning mechanism for a dielectric member of a reproduction apparatus, said cleaning mechanism comprising:

a housing defining a substantially cylindrical chamber having an opening in juxtaposition with said dielectric member;

a vacuum source associated with said housing chamber to induce an air flow through said opening and said cylindrical chamber; and a substantially cylindrical fiber brush rotatable about the longitudinal axis thereof with the fibers of said brush in contact with said dielectric member through said opening in said cylindrical chamber, said fiber brush being located within said cylindrical chamber of said housing such that an inner wall of said chamber is spaced from the outer extremes of said brush fibers so as to allow residual marking particles and debris to collect between said fibers to an extent sufficient to enable said fiber brush, when loaded with such marking particles and debris, to polish said dielectric member and remove fine scratches as said fiber brush is rotated with the fibers thereof cleaning said dielectric member.

6. The cleaning mechanism of claim 5 wherein said cylindrical fiber brush is located so as to be substantially concentric with said cylindrical chamber of said housing.

7. The cleaning mechanism of claim 6 wherein said inner wall of said cylindrical chamber of said housing is spaced from the outer extreme of said brush fibers a distance of a dimension up to approximately 0.09 cm.

* * * * *